United States Patent [19]

Davenport et al.

[11] Patent Number: 4,626,745

[45] Date of Patent: Dec. 2, 1986

[54] BALLAST CIRCUIT FOR LAMPS WITH LOW VOLTAGE GAS DISCHARGE TUBES

[75] Inventors: John M. Davenport, Lyndhurst; Pieter J. von Herrmann, Shaker Heights, both of Ohio

[73] Assignee: General Electric Company, Schenectady, N.Y.

[21] Appl. No.: 763,765

[22] Filed: Aug. 8, 1985

Related U.S. Application Data

[63] Continuation of Ser. No. 488,833, Aug. 26, 1983, abandoned.

[51] Int. Cl.[4] ..... H05B 35/00; H05B 37/00; H05B 39/00; H05B 41/00

[52] U.S. Cl. ..... 315/179; 315/245; 315/49; 315/290

[58] Field of Search ..... 315/290, 294, 275, 289, 315/DIG. 5, DIG. 7, 49, 53, 58, 245, 179

[56] References Cited

U.S. PATENT DOCUMENTS

| | | | |
|---|---|---|---|
| 3,781,594 | 12/1973 | Roberts | 315/DIG. 5 X |
| 4,275,337 | 1/1981 | Knoble et al. | 315/DIG. 7 X |
| 4,288,725 | 9/1981 | Morton | 315/245 |
| 4,320,325 | 3/1982 | Anderson | 315/DIG. 5 X |
| 4,350,930 | 9/1982 | Peil et al. | 315/49 |
| 4,438,369 | 3/1984 | Hicks et al. | 315/49 |

FOREIGN PATENT DOCUMENTS

| | | |
|---|---|---|
| 0011508 | 5/1980 | European Pat. Off. . |
| 331557 | 7/1930 | United Kingdom . |
| 491070 | 8/1938 | United Kingdom . |
| 511199 | 8/1939 | United Kingdom . |
| 521498 | 5/1940 | United Kingdom . |
| 1199899 | 7/1970 | United Kingdom . |
| 1493330 | 11/1977 | United Kingdom . |
| 1506539 | 4/1978 | United Kingdom . |
| 2006517A | 5/1979 | United Kingdom . |

*Primary Examiner*—Saxfield Chatmon

*Attorney, Agent, or Firm*—John P. McMahon; Philip L. Schlamp; Fred Jacob

[57] ABSTRACT

A ballast circuit arrangement for providing a predetermined desired A.C. voltage to enhance the operation of the gas discharge tube serving as the main light source in a lighting unit of the type which also comprises an incandescent filament serving as a resistive element and a supplementary light source is disclosed. The circuit arrangement operates directly from an applied 220 volt, 50 Hz or 120 volt, 60 Hz alternating current (A.C.) voltage source. The circuit arrangement comprises a capacitor connected serially with both the incandescent filament and the gas discharge tube. If desired, the incandescent filament may be replaced with a resistive element. The value of the capacitor is selected so as to reduce the applied 220 volt, 50 Hz or 120 volt, 60 Hz A.C. source to a desired range for operating the circuit in a manner to develop a desired reduced voltage for operation of the gas discharge tube. The reduced operating voltage correspondingly reduces the restrike voltage that may be necessary to operate the gas discharge tube during restrike conditions. The reduced operating voltage of the gas discharge tube readily allows for the development of the restrike voltage directly available from the typical 220 volts, 50 Hz or 120 volts, 60 Hz A.C. source. The circuit arrangement further provides for an automatic restrike voltage under reduced voltage A.C. source conditions.

3 Claims, 7 Drawing Figures

BALLAST CIRCUIT FOR LAMPS WITH LOW VOLTAGE GAS DISCHARGE TUBES

This application is a continuation of application Ser. No. 488,833 filed 4/26/83 now abandoned.

BACKGROUND OF THE INVENTION

The present invention relates to a ballast circuit for a gas discharge lamp. More particularly, the present invention relates to a ballast circuit operated directly from an alternating current (A.C.) voltage source and having a capacitor serially connected to a serially arranged incandescent filament and a gas discharge tube.

Recent improvements to the incandescent art have provided an improved lighting unit having a highly efficient gas discharge tube as the main light source and an incandescent filament as a supplementary light source. Such an improved incandescent lamp is generally described in U.S. Pat. No. 4,350,930, of Piel et al, issued Sept. 21, 1982.

The gas discharge tube has various modes of operation such as, (1) an initial high voltage breakdown mode, (2) a glow-to-arc transition mode, and (3) a steady state run mode. One of the circuit performance parameters is that the voltage applied across the gas discharge tube be such that the current flowing within the gas discharge tube is maintained above a critical value such as 60 milliamps. If the current flowing in the gas discharge tube drops below this critical value the arc condition of the gas discharge tube may extinguish, which, in turn, may cause the gas discharge tube to revert from its steady state run mode to its glow-to-arc transition mode or even to the initial breakdown mode. The reestablishment of the desired arc condition of the gas discharge tube may require a restrike voltage having a voltage value typically about 2.5 times or more than that of the operating voltage of the gas discharge tube.

The restrike voltage necessary for a gas discharge tube of 2.5 times its operational voltage presents a difficulty for a ballast circuit for a discharge tube operating directly from a 120 volt, 60 Hz A.C. source. For example, if the gas discharge tube has an operating voltage of 80 volts A.C. a restrike voltage of $80\times2.5=200$ volts or more is typically necessary and which voltage value is not ordinarily available from the peak-voltages of a typical 120 volt, 60 Hz A.C. source. It is considered desirable to provide means for reducing the operating voltage of a gas discharge tube, which, in turn, reduces the value of the necessary restrike voltage, which, in turn, more readily allows development of the restrike voltage from the peak voltage value of a typical 120 volt, 60 Hz A.C. source, which, in turn, more readily allows the ballast circuit to operate the gas discharge tube directly from a 120 volt, 60 Hz A.C. source.

A further difficulty involved with a ballast circuit is its ability to adapt to changes in the voltage and frequency parameters of the A.C. source. The voltage and frequency parameters are determined by the available power source. For example, the circuit parameters of a ballast circuit are typically selected for the applied A.C. source so that a ballast circuit operating with an applied A.C. source of 120 volts, 60 Hz does not perform in a successful manner when the applied A.C. source is changed from a 120 volt, 60 Hz A.C. source, typically available for U.S. utilization, to a 220 volt, 50 Hz A.C. source typically available for European utilization and elsewhere in the world. It is considered desirable to provide a ballast circuit for an gas discharge tube operable directly from either a 120 volt, 60 Hz A.C. power source or with suitable component selection for a 220 volt, 50 Hz power source.

Accordingly, objects of the present invention are to provide (1) a ballast circuit directly operable from an A.C. source and (2) to provide such a ballast circuit which directly operates with either 120 volts, 60 Hz A.C. power source or a 220 volt, 50 Hz A.C. power source.

SUMMARY OF THE INVENTION

In accordance with the present invention a lighting unit having a ballast circuit operating directly from various alternating current (A.C.) sources provides a desired operating voltage for a gas discharge tube having a serially connected incandescent tungsten filament.

In one embodiment a lighting unit has a gas discharge tube as the main light source, a filament serving as a resistive element and as a supplementary light source. The filament is in serial arrangement with the gas discharge tube as is a starting circuit and a capacitor. The resistive-capacitive ballast circuit is adapted to accept various applied alternating current (A.C.) voltages across its terminals. The ballast circuit develops A.C. operating voltage for a gas discharge tube. The ballast circuit comprises a capacitor serially connected between one of the terminals having the A.C. voltage source applied and the serial arrangement of the filament and the gas discharge tube. The capacitor is selected to have a value so as to reduce the A.C. voltage which is applied across the gas discharge tube and filament combination by a factor in the range of about 3 to about 1.

The subject matter which is regarded as the invention is particularly pointed out and distinctly claimed in the concluding portion of the specification. The invention, however, along with the method of operation and together with further objects and advantages thereof may best be understood by reference to the following description taken in conjunction with the accompanying drawings.

DETAILED DESCRIPTION OF THE PREFERRED EMBODIMENT

Figure 1:
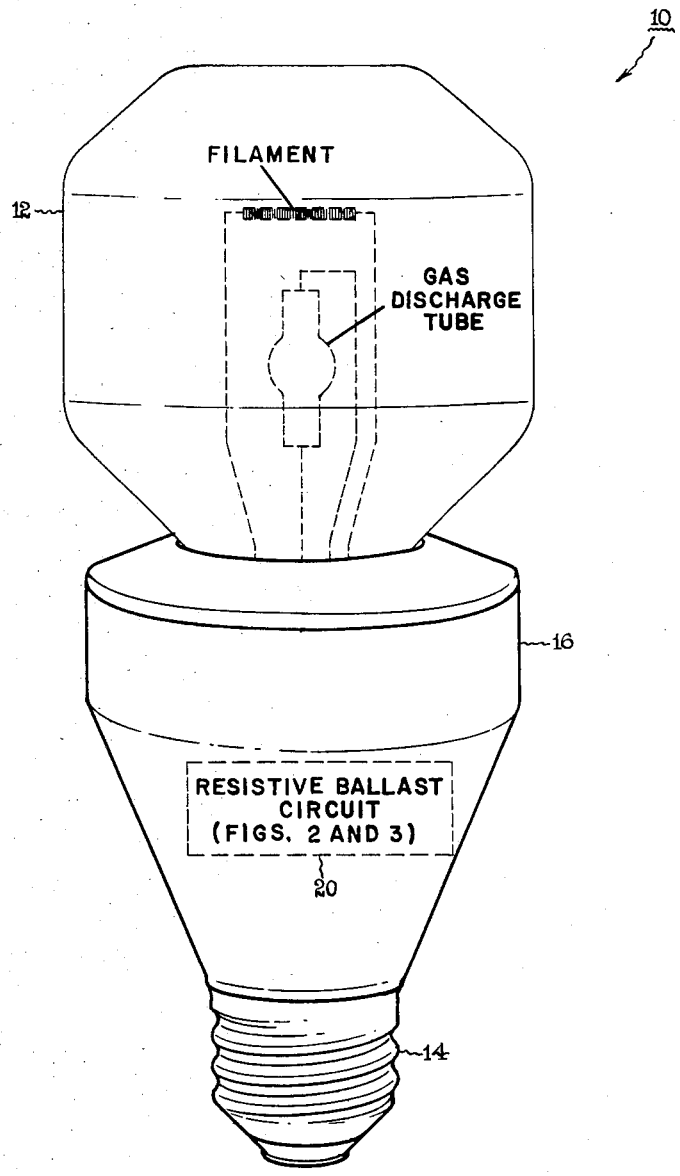
FIG. 1 shows a lighting unit in accordance with the present invention.

FIG. 1 shows a lighting unit 10 having a gas discharge tube (shown in phantom) as the main light source, and a filament as a supplementary light source (also shown in phantom) spatially disposed within a light-transmissive outer envelope 12. The lighting unit 10 has an electrically conductive base 14 and a housing 16 for lodging the electrical components of the lighting unit 10. FIG. 1 further shows the housing as confining a resistive ballast circuit 20 shown more clearly in FIG. 2.

Figure 2:
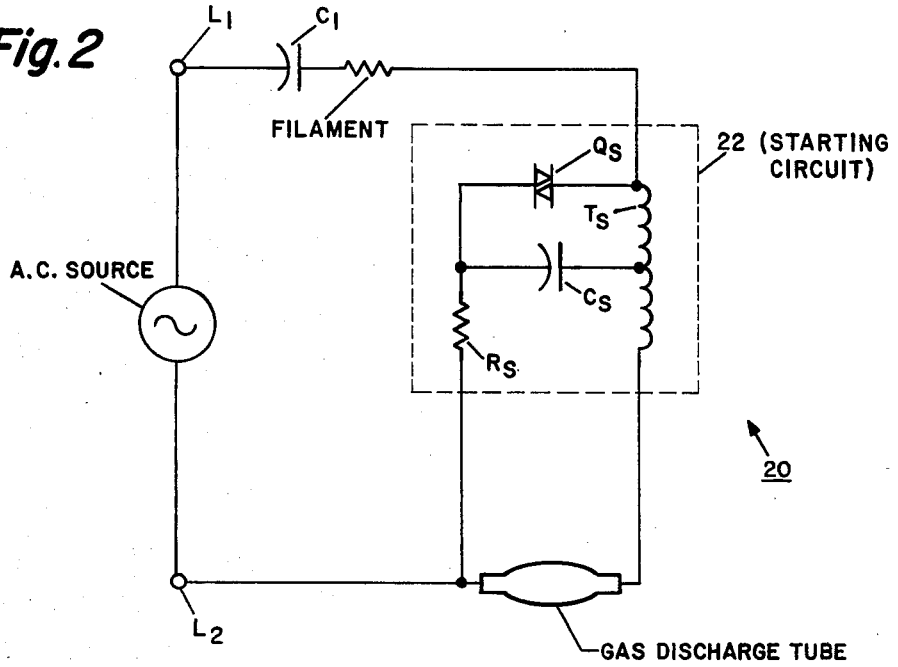
FIG. 2 is a circuit arrangement in accordance with one embodiment of the present invention.

FIG. 2 shows the circuit arrangement of a resistive-capacitive ballast circuit 20 for the lighting unit 10 wherein the filament provides the resistive element. If desired, the filament may be replaced by a resistor. The ballast circuit 20 of FIG. 2 is operable from an alternating current (A.C.) source of either 120 volts, 60 Hz or of 220 volts, 50 Hz applied across its first and second terminals L1 and L2 each having an appropriate connection (not shown) to the electrically conductive base 14. The ballast circuit 20 develops an A.C. operating voltage for the gas discharge tube having a starting circuit 22. The gas discharge tube is serially arranged with the tungsten filament as shown in FIG. 2. The gas discharge tube may be of the highly efficient type described in U.S. Pat. No. 4,161,672 of D. M. Cap and W. H. Lake, issued July 17, 1979.

The ballast circuit 20 has various typical parameters and typical component values given in Table 1 which are selected for operation with either a typical A.C. applied source of 120 volts at 60 Hz or a typical A.C. applied source of 220 volts at 50 Hz.

TABLE 1

| Parameter/Component Value | 120 V 60 Hz | 220 V 50 Hz |
|---|---|---|
| $C_1$ | 40 μf | 10 μf |
| Lamp operating Voltage $V_{Lamp}$ | 25 Volts | 60 Volts |
| Power Input ($P_{IN}$) to ballast circuit 20 | 62 watts | 51.5 watts |
| Power ($P_{Lamp}$) applied to gas discharge tube | 33.0 watts | 33.8 watts |
| Current ($I_d$ (R.M.S.) of gas discharge tube | 1.7 amps | 1.0 amps |
| Circuit Efficacy ($P_{Lamp}/P_{IN}$) | approximately 0.53 | approximately 0.65 |

The lamp operating voltage $V_{Lamp}$ of Table 1, and Table 3 to be discussed, is the value of voltage observed across the gas discharge tube only when the gas discharge tube is conductive.

The resistive-capacitive ballast circuit 20 is serially arranged between terminal $L_1$ having the applied A.C. voltage source and the serial arrangement of the filament and the gas discharge tube having the starting circuit 22. FIG. 2 shows the arrangement of the starting circuit 22 as comprised of a plurality of conventional elements of the type indicated or having typical component values both as given in Table 2.

TABLE 2

| Element | 120 V Value or Type (120 VAC) | 220 V Value or Type (220 VAC) |
|---|---|---|
| $Q_S$ | SIDAC type K120 of Teccor Co. | SIDAC type K240 |
| $C_S$ | Capacitor 0.05 μf | Capacitor 0.05 μf |
| $T_S$ | Autotransformer construction using a pair of Ferroxcube | Autotransformer construction using a pair of Feroxcube |

TABLE 2-continued

| Element | 120 V Value or Type (120 VAC) | 220 V Value or Type (220 VAC) |
|---|---|---|
| | type 813E187-3E2A E Cores and a type 990-023-01 bobbin wound with a 20 turn primary and a 400 turn secondary | type 813E187-3E2A E Cores and a type 990-023-01 bobbin wound with a 20 turn primary and a 400 turn secondary |
| $R_S$ | Resistor having a value of 15KΩ and a rating of 1 watt | Resistor having a value of 50KΩ and a rating of 1 watt |

The starting circuit 22 provides the necessary voltages so as to transition the gas discharge tube from its (1) initial state requiring a high applied voltage to cause an initial arcing of the gas discharge tube, (2) to its glow-to-arc mode, and then (3) its final steady state run condition. The starting circuit 22 operates in the following manner, (1) when the gas discharge tube is initially energized it is a relatively high impedance device so that the current initially flows through $R_S$ charging $C_S$, (2) when the voltage on capacitor $C_S$ equals or exceeds the breakdown or turn-on voltage (approximately 120 volts) of the SIDAC $Q_S$, connected in a parallel manner across $C_S$, via a ferrite transformer $T_S$, $Q_S$ is rendered conductive, (3) the conductive $Q_S$ provides a low impedance path so that the energy stored on capacitor $C_S$ is suddenly discharged, through the primary of $T_S$ which produces a potential sufficient for ionization of the gas discharge tube, (4) this discharge energy is of a sufficient magnitude to cause an initial arcing condition of the gas discharge tube, (5) the gas discharge tube then sequences from its initial state to its glow-mode and finally to its steady-state run mode, (6) when the gas discharge tube is in its steady state run condition it becomes a relatively low impedance and low voltage device so that the current is preferentially directed to the gas discharge tube, and finally (7), the starting circuit 22 is effectively removed from the ballast circuit 20 since the conducting lamp prevents the voltage on $C_S$ from reaching the turn on voltage of the SIDAC. The ballast circuit 20 with the starting circuit 22 removed is shown in FIG. 3.

Figure 3:
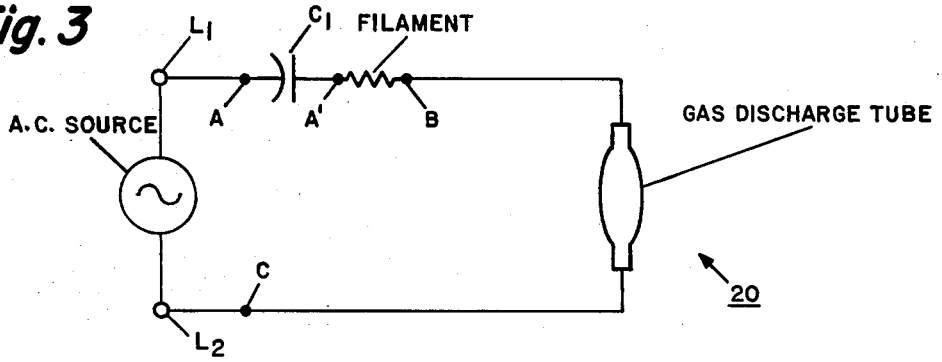
FIG. 3 is similar to FIG. 1 and shows the essential elements of the present invention.

The circuit arrangement 20 of FIG. 3 provides a ballast circuit for developing A.C. operating voltage for the gas discharge tube. The ballast circuit 20 is comprised of a capacitor $C_1$ and allows operating directly from an A.C. source having typical parameters of 120 volts, 60 Hz or 220 volts, 50 Hz with the appropriate selection by parameters and component values given in Table 1. The capacitor $C_1$ is of substantial importance to the present invention in that it provides a means for reducing the A.C. operating voltage of the gas discharge tube to desired values, which, in turn, reduces the amplitude restrike voltage to desired values that may be necessary under restrike conditions, which, in turn, allows for the restrike voltage to be developed from the A.C. source. Further, the capacitor $C_1$ by storing a charge during the time duration when the gas discharge tube is non-conducting, provides a voltage which is additive to the line voltage both of the voltages being used to promote restrike of the gas discharge tube. Additionally, the capacitor $C_1$ adapts the operation of the gas discharge tube to either a 120 volt, 60 Hz source or a 220 volt, 50 Hz source. In order that the ballast circuit 20 of the present invention may be more clearly appreciated reference is now made to the circuit of FIG. 4 which does not incorporate the present invention.

Figure 4:
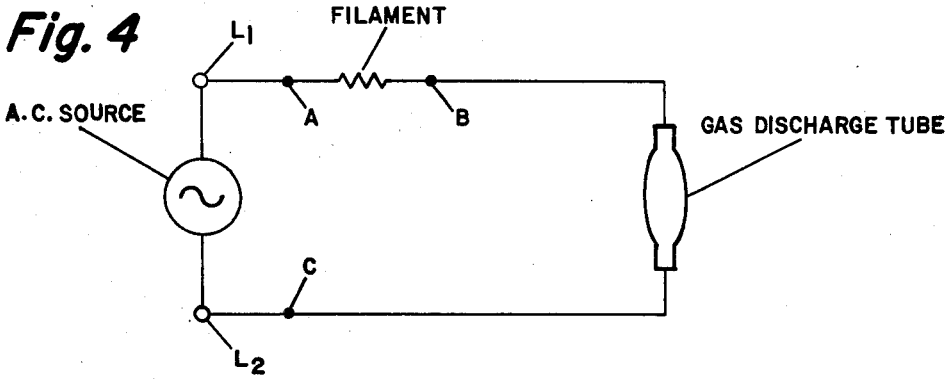
FIG. 4 shows a circuit arrangement for a gas discharge tube and a serially arranged filament connected directly to an A.C. source.
Figure 5:
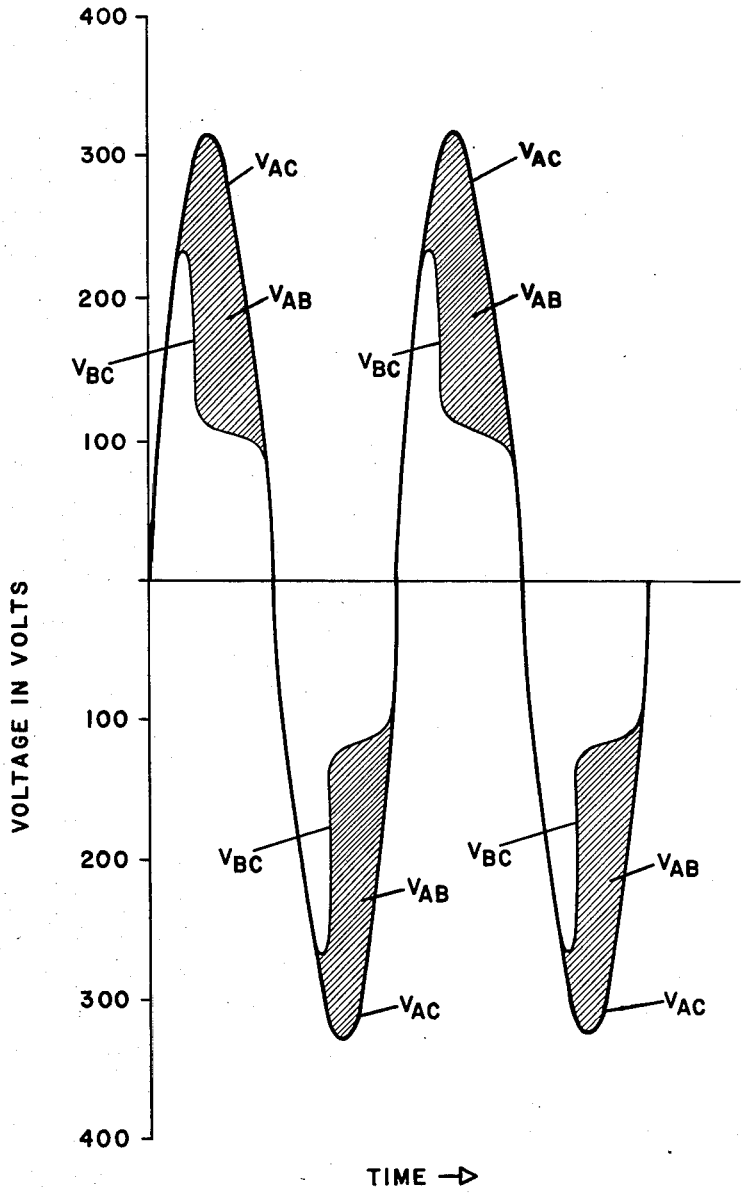
FIG. 5 is a chart showing the waveforms related to the circuit operation of FIG. 4.

FIG. 4 shows the A.C. source directly applied to the serial arrangement of the filament and gas discharge tube. FIG. 4 further shows the points A and B located on either side of the filament and a point C located on one end of the gas discharge tube which is connected to the A.C. source. The voltage between points A and C which is the voltage of the A.C. source and is herein termed $V_{AC}$. Similarly, the voltage between points B and C which is the voltage applied across the gas discharge tube is herein termed $V_{BC}$. The voltage $V_{AC}$ is divided between the serially arranged filament and operating gas discharge tube. The division of $V_{AC}$ is determined by the voltage of the operating gas discharge tube with the remaining voltage appearing across the filament. The voltage across the filament of FIG. 3 is herein termed $V_{AB}$. Reference is now made to FIG. 5 showing the voltages $V_{AC}$, $V_{BC}$ and $V_{AB}$, shown in hatched representation between $V_{AC}$ and $V_{AB}$, for the circuit arrangement of FIG. 4.

FIG. 5 shows the amplitude of the voltage $V_{AC}$, $V_{BC}$ and $V_{AB}$ along its Y axis and repetitive duration or time of the voltages $V_{AC}$, $V_{BC}$ and $V_{AB}$ along its X axis. FIG. 5 is related to an applied A.C. voltage having a typical value of 220 volts and a frequency of 50 Hz.

From FIG. 5 it is seen that $V_{BC}$ has a peak amplitude of about 250 volts. This amplitude corresponds to an operating voltage for the gas discharge tube of approximately 100 volts. As discussed in the "Background" the restrike voltage of the gas discharge tube that may be necessary under restrike conditions of the gas discharge tube is typically 2.5 times that of the opration voltage of the gas discharge tube so that an operation voltage of 100 volts would require a restrike voltage of approximately 250 volts. While such a restrike voltage of 250 volts is available from being directly derived from the A.C. source voltage $V_{AC}$ having a peak value of approximately 310 volts, the circuit arrangement of FIG. 4 having the waveforms of FIG. 5 has an undesirable efficiency rating relative to the values of voltages $V_{AB}$ and $V_{BC}$ of the filament and gas discharge tube respectively. The waveforms of FIG. 5 are meant to show that area occupied by $V_{BC}$ (voltage across the gas discharge tube) is only about 30% of $V_{AC}$ (source voltage).

The area of $V_{AB}$ relative to the area of $V_{AC}$ represents that about 200 volts of the A.C. voltage $V_{AC}$ is used to maintain excitation of the filament, whereas, the area of $V_{BC}$ is meant to represent that only about 100 volts of the A.C. voltage is used to maintain excitation of the gas discharge tube. It is desired that the great majority of the voltage $V_{AC}$ be used for the primary light source gas discharge tube, and conversely, a minor amount of the voltage $V_{AC}$ be used for the supplementary light source filament. The ratio of $V_{AC}$ between the gas discharge tube and filament is a measurement of the ballast circuit efficiency and the waveform $V_{AB}$, $V_{BC}$ and $V_{AC}$ of FIG. 5 represent a relative low circuit efficiency of about 30%. Similar manipulations for the operating voltage, the restrike voltage, and peak values available from an A.C. source of 120 volts at 60 Hz would render the circuit arrangement of FIG. 4 undesirable for direct operation from an A.C. source of 120 volts at 60 Hz.

The disadvantages of the circuit arrangement of FIG. 4 are overcome by the circuit arrangement of the present invention shown in FIG. 3. FIG. 3 is structurally similar to FIG. 4 with the exception that the capacitor $C_1$ is connected between the A.C. source and the serial arrangement of the filament and gas discharge tube. FIG. 3 shows points A, A' located on opposite sides of capacitor $C_1$, point B arranged between the filament and one end of the gas discharge tube and point C located at the other end of the gas discharge tube which is also connected to the A.C. source. The voltages related to the FIG. 3 are herein indicated and shown in FIG. 6.

Figure 6:
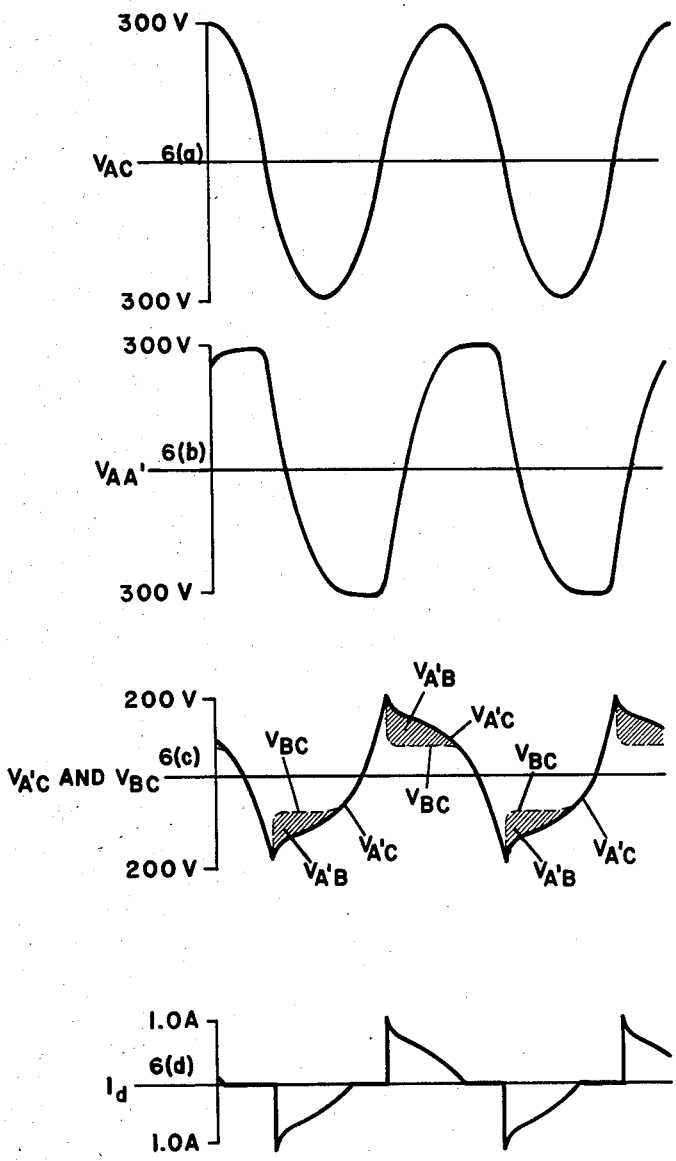
FIG. 6 is a chart showing the voltages related to the operation of the circuit arrangement of FIG. 3 applicable for an applied 220 volt, 50 Hz A.C. source.

FIG. 6 is segmented into four sections, (1) FIG. 6(*a*) showing $V_{AC}$ which is the A.C. source voltage having peak values of about 300 volts, (2) FIG. 6(*b*) showing $V_{AA'}$ which is the voltage across the capacitor $C_1$ having a peak value somewhat less than 300 volts, (3) FIG. 6(*c*) showing, (a) $V_{A'C}$ which is the voltage applied across the filament and gas discharge tube having a peak value of about 200 volts, (b) $V_{BC}$ (partially shown in phantom) which is the voltage applied across the gas discharge tube having a peak value of about 200 volts, and (c) $V_{A'B}$ which is the voltage applied across the filament and is shown in FIG. 6(*c*) as a hatched representation between $V_{A'C}$ and $V_{BC}$, and (4) FIG. 6(*d*) showing $I_d$ which is the current flowing through the arc discharge tube.

The voltage $V_{BC}$ of FIG. 6(*c*) has a relatively low peak value, such as approximately 110 volts, compared to that of $V_{BC}$ of FIG. 5. This peak amplitude of 110 volts corresponds to an operating voltage for a gas discharge tube of approximately 60 volts. As discussed in the "Background" section and FIG. 5, the operating voltage typically necessitates a restrike voltage of 2.5 times that of the operating voltage. However, an operating voltage of 60 volts developed by the circuit arrangement of FIG. 3 only necessitated a restrike voltage of 150 volts. Such a restrike voltage of 150 volts is readily available from being directly derived from the A.C. source voltage $V_{AC}$ of FIG. 6 having a peak value of 310 and is well within the limits desired for the restrike voltage. The lower restrike voltage provided by the circuit arrangement of FIG. 3 relative to FIG. 4 allows the ballast circuit of the present invention to be directly operated from an A.C. source of 220 volts at 50 Hz in a desirable manner. Similar manipulation for the operating voltage, restrike voltage, and peak values available from an A.C. source of 120 volts at 60 Hz would show the circuit arrangement of FIG. 3 directly operable from an A.C. source of 120 volts at 60 Hz in a desirable manner. The related waveforms of the circuit arrangement of FIG. 3 along with the associated description for having an applied A.C. source of 220 volts at 50 Hz are essentially the waveforms and associated description of FIG. 6 with the waveforms being scaled down by a factor of about 2 to 1 so as to show and describe the circuit operation of FIG. 3 for an applied 120 volt, 60 Hz source.

Still further, the circuit arrangement of FIG. 3 having the waveforms of FIG. 6 has a desirable efficiency rating relative to the values of the voltage $V_{A'B}$ and $V_{BC}$ of the filament and gas discharge tube respectively. In a manner as previously described with regard to the waveforms of FIG. 5, the waveforms $V_{A'B}$ and $V_{BC}$ of FIG. 6 are representative of a relatively high efficiency rating of 0.65.

The circuit arrangement of FIG. 3 provides for the desired operation of the gas discharge tube even in the presence of a relatively low applied voltage that may be experienced during the commonly termed "brown-out" electrical power curtailment conditions. The desired operation of the circuit arrangement of FIG. 3 in response to relatively low voltage conditions is best described by first referring to FIG. 7.

Figure 7:
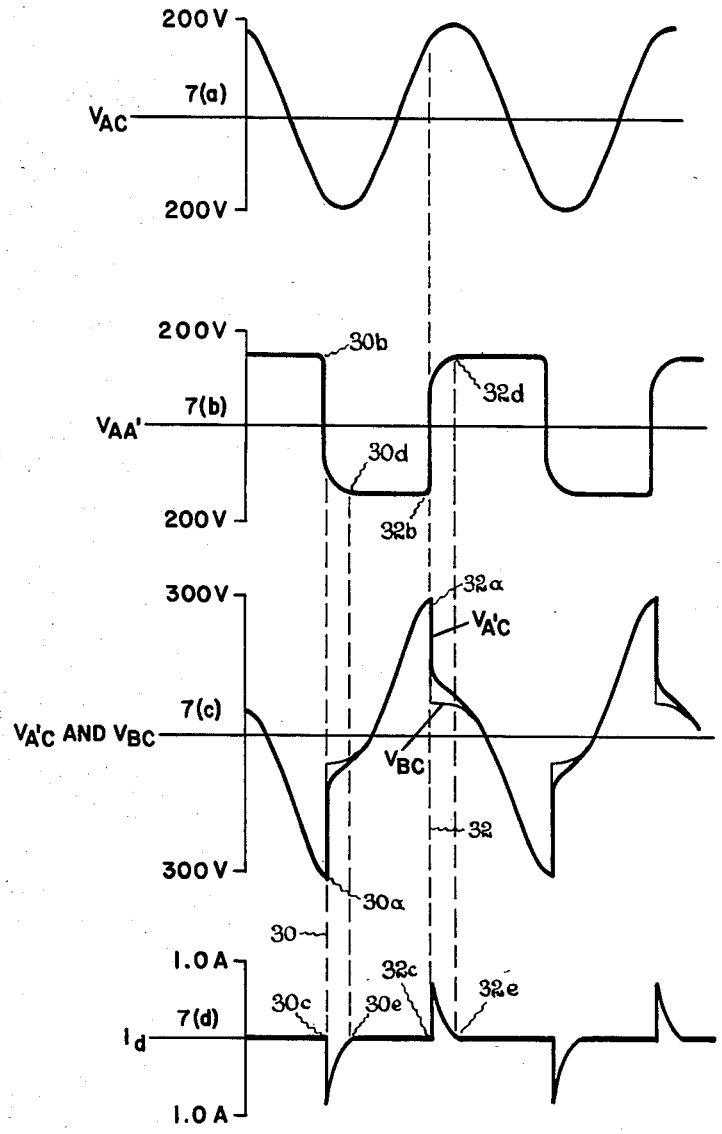
FIG. 7 is a chart showing the voltages related to the operation of the circuit arrangement of FIG. 3 in response to a reduced 220 volt, 50 Hz A.C. source.

FIG. 7 is similar to the previously described FIG. 6 and is segmented into, (1) FIG. 7(*a*) showing the voltage $V_{AC}$ having relatively low peak values of approximately 200 volts, (2) FIG. 7(*b*) showing the voltage $V_{AA'}$ having peak values of approximately 150 volts, (3) FIG. 7(*c*) showing the voltage $V_{A'C}$ having peak values of approximately 300 volts and also showing $V_{BC}$, and (4) FIG. 7(*d*) showing the current $I_d$. Without the practice of this invention, the relatively low voltage of approximately 200 volts of $V_{AC}$ of FIG. 7(*a*) would be typically insufficient to maintain conduction of the gas discharge tube.

In general, the circuit arrangement of FIG. 3, having the waveforms of FIG. 7, operates such that the voltage $V_{AA'}$ of FIG. 7(*b*) which is the voltage across the capacitor $C_1$, is preserved when $I_d=0$ and additive to the input voltage $V_{AC}$ of FIG. 7(*a*) during the next half cycle which voltage $V_{A'C}$ of FIG. 7(*c*) is applied to the filament and gas discharge tube. The operation of the circuit arrangement automatically provides a restrike voltage having a value in excess of the peak value of $V_{AC}$ to the gas discharge tube which inhibits the extinction of the arc conditions of the gas discharge tube under reduced voltage conditions of $V_{AC}$. The capacitor $C_1$ is charged to nearly the peak value of $V_{AC}$ so as to form $V_{AA'}$ of FIG. 7(*b*) during the non-conductive state of the gas discharge tube and which becomes additive to $V_{AC}$. The combined $V_{AA'}$ and $V_{AC}$ forms the restrike voltage to maintain the arc conditions of the gas discharge tube under the reduced voltage condition of $V_{AC}$ of FIG. 7(*a*).

FIG. 7 shows, in phantom, two vertical lines 30 and 32 respectively having components $\mathbf{30}_a$, $\mathbf{30}_b$, $\mathbf{30}_c$, $\mathbf{30}_d$, $\mathbf{30}_e$ and $\mathbf{32}_a$, $\mathbf{32}_b$, $\mathbf{32}_c$, $\mathbf{32}_d$ and $\mathbf{32}_e$. The vertical line 30 and its components is meant to show the initiation of the conductive state of the gas discharge tube during the negative relatively low voltage conditions of $V_{AC}$, whereas, vertical line 32 and its components is meant to show initiation of the conductive state of the gas discharge tube during the positive relatively low voltage condition of $V_{AC}$.

The components $\mathbf{30}_a$, $\mathbf{30}_b$, $\mathbf{30}_c$, $\mathbf{30}_d$, and $\mathbf{30}_e$ are respectively meant to represent and show, (1) the negative peak value of $V_{A'C}$ of FIG. 7(*c*) which is the restrike voltage applied to the gas discharge tube under reduced voltage condition of $V_{AC}$ of FIG. 7(*a*) and $V_{A'C}$ has a value of approximately 300 volts, (2) the positive peak value of $V_{AA'}$ of FIG. 7(*b*) which is additive to $V_{AC}$ of FIG. 7(*a*) so as to form the peak restrike voltage of $V_{A'C}$, (3) the initiation of conduction of the gas discharge tube shown in FIG. 7(*d*) by the negative transition of $I_d$ in response to the peak restrike voltage of $V_{A'C}$, (4) the knee of the discharge curve of $V_{A'A}$ of FIG. 7(*b*) representing that the majority of the charge stored on $C_1$ has discharged into the gas discharge tube, and (5) the termination of conduction of the gas discharge tube shown in FIG. 7(*d*) by the positive transition of $I_d$ in response to the decay of the restrike voltge of $V_{A'C}$.

The line 32 and its components $\mathbf{32}_a$, $\mathbf{32}_b$, $\mathbf{32}_c$, $\mathbf{32}_d$, and $\mathbf{32}_e$ are meant to represent and show the operation of the circuit arrangement of FIG. 3 which causes the positive conduction of current $I_d$ of FIG. 7(*d*) during the reduced positive voltage conditions of $V_{AC}$ of FIG. 7(*a*). The description related to line 30 and its components $\mathbf{30}_a$, $\mathbf{30}_b$, $\mathbf{30}_c$, $\mathbf{30}_d$ and $\mathbf{30}_e$ is respectively applicable to line 32 and its components $\mathbf{32}_a$, $\mathbf{32}_b$, $\mathbf{32}_c$, $\mathbf{32}_d$ and $\mathbf{32}_e$ except for their voltage polarity relationships.

The values of the voltages of FIGS. 6 and 7 are adaptable to the desired operating voltage and restrike voltages of the gas discharge tube by appropriate selection of the value of the capacitor $C_1$. In a manner as previously mentioned with regard to Table 1, Table 3 lists typical values of $C_1$, relative to the parameters previously discussed hereinbefore, for application with typical values of the applied A.C. voltage $V_{AC}$.

TABLE 3

| $V_{AC}$ | $V_{Lamp}$ in Volts | $C_1$ in μf | $P_{Lamp}$ in Watts | $P_{IN}$ in Watts | $I_d$ in Amperes |
|---|---|---|---|---|---|
| 115 V at 60 Hz | 25.0 | 40 | 33 | 62 | 1.7 |
| 115 V | 25.0 | 65 | 51 | 104 | 2.3 |
| 220 V at 50 Hz | 60.0 | 10 | 33.8 | 51.5 | 1.0 |
| 220 V at 50 Hz | 65.0 | 8 | 26.3 | 40.4 | 0.985 |
| 220 V at 50 Hz | 68.0 | 6 | 22.5 | 34.2 | 0.504 |
| 220 V at 50 Hz | 68.2 | 6 | 21.7 | 37.8 | 0.446 |
| 240 V at 50 Hz | 70.0 | 6 | 24.5 | 42.5 | 0.446 |
| 260 V at 50 Hz | 70.6 | 6 | 27.3 | 47.9 | 0.487 |
| 280 V at 50 Hz | 80.0 | 4 | 20.0 | 31.0 | 0.31 |

It should now be appreciated that the lighting unit 10 having the resistive ballast 20 is directly operable from an A.C. source and the A.C. source may be either of 120 volts at 60 Hz or 220 volts at 50 Hz by appropriate selection of capacitor $C_1$. The resistive ballast circuit has a relatively high efficiency rating. The resistive ballast circuit 20 provides such direct operation and develops an A.C. operating voltage for desired performance by the main light source highly efficient gas discharge tube along with desired performance of the supplementary light source filament.

What we claim as new and desire to secure by Letters Patent of the United States is:

1. In a lighting unit having a gas discharge tube as the light source, a resistive element in serial arrangement with said gas discharge tube, and a starting circuit for said gas discharge tube, said starting circuit having means for generating voltages so as to transition said gas discharge tube from its (1) intitial state requiring a high voltage to cause an initial arcing of the gas discharge tube, (2) to its glow-to-arc mode, and then (3) its final steady state run condition, and a resistive-capacitive ballast circuit formed in part by said resistive element and adapted by the appropriate selection of the values of a capacitive component of said resistive-capacitive ballast circuit to accept various applied alternating current (A.C.) voltages across its terminals and developing an A.C. operating voltage for said gas discharge tube, said app.ied A.C. voltages having values in the range of 115 to 280 volts at frequencies in the range of 50 to 60 Hz, wherein said capacitive components of said resistive-component ballast circuit consists of:

a capacitor serially connected between one of the terminals having said applied A.C. voltages and said serial arrangement of said resistive element and said gas discharge tube;

said value of said capacitor being in the range of about 4 $\mu$f to about 65 $\mu$f so as to reduce said A.C. voltage in the development of said A.C. operating voltage of said gas discharge tube having reduced restrike voltage requirements and resistive element combination by a factor in the range of about 3 to about 1.

2. A resistive-capacitive ballast circuit according to claim 1 wherein said ballast circuit develops said A.C. operating voltage even when subjected to a reduction of said applied A.C. source by a factor of about one-third ($\frac{1}{3}$).

3. A resistive-capacitive ballast circuit according to claim 1 wherein said resistive element comprises a filament and serves as a supplementary light source of said lighting unit.

* * * * *